US011022086B2

(12) United States Patent
Burrows et al.

(10) Patent No.: US 11,022,086 B2
(45) Date of Patent: Jun. 1, 2021

(54) OPTIMIZED BARRIER DISCHARGE DEVICE FOR CORONA IGNITION

(71) Applicant: Tenneco Inc., Lake Forest, IL (US)

(72) Inventors: John Antony Burrows, Manchester (GB); Fu Xing Chan, Manchester (GB); James D. Lykowski, Temperance, MI (US)

(73) Assignee: Tenneco Inc., Lake Forest, IL (US)

( * ) Notice: Subject to any disclaimer, the term of this patent is extended or adjusted under 35 U.S.C. 154(b) by 42 days.

(21) Appl. No.: 16/656,151

(22) Filed: Oct. 17, 2019

(65) Prior Publication Data

US 2020/0124017 A1 Apr. 23, 2020

Related U.S. Application Data

(60) Provisional application No. 62/748,021, filed on Oct. 19, 2018.

(51) Int. Cl.

| | |
|---|---|
| ***F02P 23/00*** | (2006.01) |
| ***F02P 23/04*** | (2006.01) |
| ***H01B 17/42*** | (2006.01) |
| ***H01T 19/00*** | (2006.01) |

(52) U.S. Cl.

CPC ..... *F02P 23/04* (2013.01); *H01B 17/42* (2013.01); *H01T 19/00* (2013.01)

(58) Field of Classification Search

CPC ..... F02P 23/04; H01B 17/42; H01T 19/00; H01T 13/52; H01T 13/34; H01T 13/36; H01T 13/50

See application file for complete search history.

(56) References Cited

U.S. PATENT DOCUMENTS

| | | | | |
|---|---|---|---|---|
| 2,733,369 A | | 1/1956 | Smits | |
| 3,974,412 A | | 8/1976 | Pratt, Jr. | |
| 4,841,925 A | * | 6/1989 | Ward | F02P 3/0884 123/143 B |

(Continued)

FOREIGN PATENT DOCUMENTS

| | | |
|---|---|---|
| EP | 3029785 A1 | 6/2016 |
| WO | 2010129535 A2 | 11/2010 |

OTHER PUBLICATIONS

International Search Report, dated Jan. 20, 2020 (PCT/US2019/056920).

*Primary Examiner* — Phutthiwat Wongwian
*Assistant Examiner* — Sherman D Manley
(74) *Attorney, Agent, or Firm* — Robert L. Stearns; Dickinson Wright, PLLC

(57) ABSTRACT

An insulator for a corona igniter, referred to as a barrier discharge ignition (BDI) device, for use in an internal combustion engine, is provided. A central electrode is disposed in a slot of the insulator and an electrode tip is spaced from a round insulator tip by insulating material. A shell formed of metal surrounds a portion of the insulator. The insulator has a thickness tapering between a shell firing surface and the insulator tip. The tapering insulator thickness is unidirectional and thus does not increase between a start of the taper and the insulator tip. A method of manufacturing an insulator for a corona igniter is also provided. Equations can be used to determine if a taper in the insulator thickness is needed to encourage corona propagation along a core nose projection of the insulator, and if so, the location and size of the taper.

22 Claims, 11 Drawing Sheets

(56) References Cited

U.S. PATENT DOCUMENTS

| | | | | |
|---|---|---|---|---|
| 5,469,013 | A * | 11/1995 | Kang | H01T 13/50 313/128 |
| 8,217,560 | B2 | 7/2012 | Giffels et al. | |
| 8,844,490 | B2 * | 9/2014 | Burrows | H01T 13/50 123/143 B |
| 9,525,272 | B2 | 12/2016 | Bohne et al. | |
| 9,929,541 | B2 * | 3/2018 | Saito | H01T 13/52 |
| 9,931,458 | B1 | 4/2018 | Di Naro | |
| 10,107,252 | B2 | 10/2018 | Ban et al. | |
| 2010/0117507 | A1 * | 5/2010 | Suzuki | H01T 13/34 313/143 |
| 2010/0282197 | A1 * | 11/2010 | Permuy | H01T 13/50 123/143 B |
| 2012/0210968 | A1 * | 8/2012 | Burrows | H01T 21/02 123/143 B |
| 2013/0075132 | A1 * | 3/2013 | Sasaki | H01R 9/223 174/140 R |
| 2014/0174416 | A1 * | 6/2014 | Okabe | H01T 13/52 123/608 |
| 2016/0157332 | A1 * | 6/2016 | Ban | H05H 1/52 315/246 |
| 2016/0369764 | A1 * | 12/2016 | Ban | F02P 23/04 |

* cited by examiner $$E_{GAP} \ \alpha \ \frac{\varepsilon_{inuslator}}{R_{INS} \cdot \left[\varepsilon_{air} \cdot ln\left(\frac{R_{INS}}{R_{CE}}\right) \varepsilon_{inuslator} \cdot ln\left(\frac{R_{SHELL}}{R_{INS}}\right)\right]}$$

Equation 4.1

$$RATIO = \frac{R_{INS}}{CEP}$$

Equation 4.2

$$V_{GAP} \ \alpha \ \frac{\varepsilon_{inuslator} \cdot ln\left(\frac{R_{SHELL}}{R_{INS}}\right)}{\varepsilon_{air} \cdot ln\left(\frac{R_{INS}}{R_{CE}}\right)}$$

Equation 4.3

$$X = 0.5007 \ x \ (R_{SHELL} - R_{INS}) = 0.5697$$

Equation 4.4

$$RATIO' = \frac{R_{INS}}{CEP} - X$$

Equation 4.5

$$X = 2.9\% \ x \left(\frac{R_{CE}}{R_{INS} - R_{CE}}\right) + 59.56\%$$

Equation 4.6

Where:

- $E_{GAP}$ is the electric field in shell game
- $V_{GAP}$ is the voltage across shell gap
- $\varepsilon_{inuslator}$ is the relative permittivity of insulator
- $\varepsilon_{air}$ is the relative permittivity of air
- $R_{SHELL}$ is the inside radius of shell
- $R_{INS}$ is the outisde radius of insulator
- $R_{CE}$ is the outside radius of central electrode
- $C_{EP}$ is the central electrode projection (see FIG. 3)
- $C_{NP}$ is the insulator corenose projection (see FIG. 3)

FIG. 4

OPTIMIZED BARRIER DISCHARGE DEVICE FOR CORONA IGNITION

CROSS-REFERENCE TO RELATED APPLICATION

This U.S. utility patent application claims priority to U.S. provisional patent application No. 62/748,021, filed Oct. 19, 2018, the entire content of which is incorporated herein by reference.

BACKGROUND

1. Field of the Invention

This invention relates generally to insulators for corona igniters used in internal combustion engines, corona igniters, methods for manufacturing insulators and corona igniters, internal combustion engines including corona igniters, methods for manufacturing insulators and corona igniters, and methods for evaluating the design of corona igniters.

2. Related Art

Corona discharge ignition systems provide an alternating voltage and current, reversing high and low potential electrodes in rapid succession which enhances the formation of corona discharge and minimizes the opportunity for arc formation. The system typically includes a transformer receiving energy from a power supply in the form of a direct current, amplifying the voltage, and reducing the current prior to directing the energy in the form of an alternating current toward a central electrode of the corona igniter. The central electrode is charged to a high radio frequency voltage potential and creates a strong radio frequency electric field in a combustion chamber. The electric field causes a portion of a mixture of fuel and air in the combustion chamber to ionize and begin dielectric breakdown, facilitating combustion of the fuel-air mixture, which is referred to as an ignition event. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create thermal plasma and an electric arc between the electrode and grounded cylinder walls, piston, metal shell, or other portion of the igniter. An example of a corona discharge ignition system is disclosed in U.S. Pat. No. 6,883,507 to Freen.

SUMMARY

One aspect of the invention provides corona igniter. The corona igniter assembly comprises an insulator formed of an insulating material. The insulator extends longitudinally along a center axis to an insulator tip. The insulator has a thickness extending from an insulator outer surface to an insulator inner surface, the insulator inner surface presents a slot extending longitudinally along the center axis toward the insulator tip, and the insulator outer surface is round at the insulator tip. A central electrode is disposed in the slot of the insulator and extends longitudinally from an electrode upper end to an electrode tip. The electrode tip is spaced from the insulator tip by the insulating material. A shell formed of metal surrounds a portion of the insulator and extends longitudinally from a shell upper end to a shell firing surface. The insulator thickness tapers between the shell firing surface and the insulator tip, and the insulator thickness does not increase between a start of the taper and the insulator tip.

According to an embodiment, the insulator outer surface extends radially inwardly toward the insulator inner surface to present the taper in the insulator thickness.

According to another embodiment, the insulator includes a core nose projection having a length extending from the shell firing surface to the insulator tip, the taper in the insulator thickness extends along a percentage of the length of the core nose projection, and the percentage of the length is defined according to the following equation:

$$Y = -2.9\% \times \left(\frac{R_{CE}}{R_{INS} - R_{CE}}\right) + 59.56\%$$

wherein Y is the percentage of the length of the core nose projection of the insulator, $R_{CE}$ is a radius of the center electrode, the radius of the center electrode is a distance extending from the center axis to an electrode outer surface, and $R_{INS}$ is a radius of the insulator, the radius of the insulator is a distance extending from the center axis to the insulator outer surface, and the radius of the insulator is measured along a portion of the insulator wherein the insulator thickness is constant.

According to another embodiment, the insulator thickness is constant along a first portion of the insulator and tapers along a second portion of the insulator extending from the first portion toward the insulator tip, the insulator thickness at the insulator tip relative to the insulator thickness at the first portion being reduced by greater than or equal to a percentage of the insulator thickness at the first portion, the percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS} - R_{CE}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of the insulator thickness at the first portion, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, $R_{CE}$ is a radius of the center electrode, the radius of the center electrode being a distance extending from the center axis to an electrode outer surface, and $R_{SHELL}$ is a radius of the shell, the radius of the shell being a distance extending from the center axis to a shell inner surface at the shell firing surface.

According to another embodiment, the insulator thickness is constant along a first portion of the insulator and tapers continuously along a second portion of the insulator extending from the first portion to the insulator tip.

According to another embodiment, the insulating material is alumina, the shell includes a flange extending radially outwardly from the center axis and a threaded region extending longitudinally from the flange, the threaded region includes a plurality of threads, the shell includes a shell inner surface facing the center axis, the shell inner surface includes a first section presenting a cylindrical shape surrounding the center axis, the shell inner surface includes an internal seat extending from the first section and at an angle relative to the center axis, the inner surface includes a second section extending longitudinally from the internal seat to the shell firing surface and presenting a cylindrical shape surrounding the center axis, the insulator outer surface including an insulator lower shoulder extending at an angle relative to the center axis and resting on the internal seat of the shell, the shell and the insulator presenting a gap therebetween, and the gap extending from the insulator lower shoulder to the shell lower end.

Another aspect of the invention provides an insulator for a corona igniter. The corona igniter includes a center electrode for receipt in a slot of the insulator and a shell for surrounding the insulator. The insulator is formed of an insulating material and extends longitudinally along a center axis to an insulator tip. The insulator has a thickness extending from an insulator outer surface to an insulator inner surface, the insulator inner surface presents a slot extending longitudinally along the center axis toward the insulator tip, and the insulator outer surface is round at the insulator tip. The insulator thickness tapers between the insulator tip and a location to be longitudinally aligned with a shell firing surface of the shell, and the insulator thickness does not increase between a start of the taper and the insulator tip.

According to an embodiment, the insulator includes a core nose projection for extending from the shell firing surface to the insulator tip, the insulator thickness tapers along the core nose projection, the taper in the insulator thickness extends along a percentage of the length of the core nose projection, and the percentage of the length is defined according to the following equation:

$$Y = -2.9\% \times \left(\frac{R_{CE}}{R_{INS} - R_{CE}}\right) + 59.56\%$$

wherein Y is the percentage of the length of the core nose projection of the insulator, $R_{CE}$ is a radius of the center electrode, the radius of the center electrode being a distance extending from the center axis to an electrode outer surface, and $R_{INS}$ is a radius of the insulator, the radius of the insulator is a distance extending from the center axis to the insulator outer surface, and the radius of the insulator is measured along a portion of the insulator wherein the insulator thickness is constant.

According to an embodiment, the insulator thickness is constant along a first portion of the insulator and tapers along a second portion of the insulator extending from the first portion toward the insulator tip, the insulator thickness at the insulator tip relative to the insulator thickness at the first portion is reduced by greater than or equal to a percentage of the insulator thickness at the first portion, the percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS} - R_{CE}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of the insulator thickness at the first portion, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, $R_{CE}$ is a radius of the center electrode, the radius of the center electrode being a distance extending from the center axis to an electrode outer surface, and $R_{SHELL}$ is a radius of the shell, the radius of the shell being a distance extending from the center axis to a shell inner surface at the shell firing surface.

According to another embodiment, the insulator thickness tapers between the shell firing surface and the insulator tip, and the insulator outer surface extends radially inwardly toward the insulator inner surface to present the taper in the insulator thickness.

According to another embodiment, the insulator thickness does not increase between the location to be longitudinally aligned with the shell firing surface of the shell and the insulator tip.

Another aspect of the invention provides a method of manufacturing a corona igniter. The method comprises the steps of: providing an insulator formed of an insulating material, the insulator extending longitudinally along a center axis to an insulator tip, the insulator having a thickness extending from an insulator outer surface to an insulator inner surface, the insulator inner surface presenting a slot extending longitudinally along the center axis toward the insulator tip, the insulator outer surface being round at the insulator tip; providing a central electrode disposed in the slot of the insulator and extending longitudinally from an electrode upper end to an electrode tip, the electrode tip being spaced from the insulator tip by the insulating material; providing a shell formed of metal surrounding a portion of the insulator and extending longitudinally from a shell upper end to a shell firing surface. The step of providing the insulator includes providing the insulator so that the insulator thickness tapers between the shell firing surface and the insulator tip, and the insulator thickness does not increase between a start of the taper and the insulator tip.

According to an embodiment, the method includes reducing the insulator thickness at the insulator tip relative to the insulator thickness at the shell firing surface if a RATIO' defined by the following equation is less than or equal to 0:

$$RATIO' = \frac{R_{INS}}{CEP} - X$$

wherein $X=0.5007\times(R_{SHELL}-R_{INS})+0.5697$, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

According to an embodiment, the method includes increasing X by 10% before calculating the RATIO'.

According to another embodiment, the insulator includes a core nose projection having a length extending from the shell firing surface to the insulator tip, and the step of reducing the insulator thickness includes tapering the insulator thickness between the shell firing surface and the insulator tip so that the taper in the insulator thickness extends along a percentage of the length of the core nose projection, and the percentage of the length is defined according to the following equation:

$$Y = -2.9\% \times \left(\frac{R_{CE}}{R_{INS} - R_{CE}}\right) + 59.56\%$$

wherein Y is the percentage of the length of the core nose projection of the insulator, $R_{CE}$ is a radius of the center electrode, the radius of the center electrode being a distance extending from the center axis to an electrode outer surface, and $R_{INS}$ is a radius of the insulator, the radius of the insulator is a distance extending from the center axis to the insulator outer surface, and the radius of the insulator is measured along a portion of the insulator wherein the insulator thickness is constant.

According to an embodiment, the insulator includes a core nose projection having a length extending from the shell firing surface to the insulator tip, the insulator thickness is constant along a first portion of the insulator, and the step of reducing the insulator thickness includes taping the insulator thickness along a second portion of the insulator extending from the first portion toward the insulator tip so that the insulator thickness at the insulator tip relative to the insulator thickness at the first portion is reduced by greater than or equal to a percentage of the insulator thickness at the first portion, the percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS} - R_{CE}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of the insulator thickness at the first portion, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, $R_{CE}$ is a radius of the center electrode, the radius of the center electrode being a distance extending from the center axis to an electrode outer surface, and $R_{SHELL}$ is a radius of the shell, the radius of the shell being a distance extending from the center axis to a shell inner surface at the shell firing surface.

According to an embodiment, the method includes increasing a length of the shell so that the shell firing surface is closer to the insulator tip if a RATIO' defined by the following equation is less than or equal to 0:

$$RATIO' = \frac{R_{INS}}{CEP} - X$$

wherein $X=0.5007\times(R_{SHELL}-R_{INS})+0.5697$, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

Another aspect of the invention provides a method of manufacturing a corona igniter, comprising the steps of: providing an insulator formed of an insulating material, the insulator extending longitudinally along a center axis to an insulator tip, the insulator having a thickness extending from an insulator outer surface to an insulator inner surface, the insulator inner surface presenting a slot extending longitudinally along the center axis toward the insulator tip, and the insulator outer surface being round at the insulator tip; providing a central electrode disposed in the slot of the insulator and extending longitudinally from an electrode upper end to an electrode tip, the electrode tip being spaced from the insulator tip by the insulating material; providing a shell formed of metal surrounding a portion of the insulator and extending longitudinally from a shell upper end to a shell firing surface; increasing a length of the shell so that the shell firing surface is closer to the insulator tip if a RATIO' defined by the following equation is greater than or equal to 0:

$$RATIO' = \frac{R_{INS}}{CEP} - X$$

wherein $X=0.5007\times(R_{SHELL}-R_{INS})+0.5697$, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

According to an embodiment, the method includes increasing X by 10% before calculating the RATIO'.

According to another embodiment, the insulator includes a core nose projection having a length extending from the shell firing surface to the insulator tip, the method includes reducing the insulator thickness at the insulator tip relative to the insulator thickness at the shell firing surface if the RATIO' is less than or equal to 0, and the step of reducing the insulator thickness includes tapering the insulator thickness between the shell firing surface and the insulator tip so that the taper in the insulator thickness extends along a percentage of the length of the core nose projection, and the percentage of the length is defined according to the following equation:

$$Y = -2.9\% \times \left(\frac{R_{CE}}{R_{INS} - R_{CE}}\right) + 59.56\%$$

wherein Y is the percentage of the length of the core nose projection of the insulator, $R_{CE}$ is a radius of the center electrode, the radius of the center electrode being a distance extending from the center axis to an electrode outer surface, and $R_{INS}$ is a radius of the insulator, the radius of the insulator being a distance extending from the center axis to the insulator outer surface along a portion of the core nose projection wherein the insulator thickness is constant.

According to another embodiment, the insulator includes a core nose projection having a length extending from the shell firing surface to the insulator tip, the insulator thickness is constant along a first portion of the insulator, and the step of reducing the insulator thickness includes taping the insulator thickness along a second portion of the insulator extending from the first portion toward the insulator tip so that the insulator thickness at the insulator tip relative to the insulator thickness at the first portion is reduced by greater than or equal to a percentage of the insulator thickness at the first portion, the percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS} - R_{CE}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of the insulator thickness at the first portion, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, $R_{CE}$ is a radius of the center electrode, the radius of the center electrode being a distance extending from the center axis to an electrode outer surface, and $R_{SHELL}$ is a radius of the shell, the radius of the shell being a distance extending from the center axis to a shell inner surface at the shell firing surface.

Another aspect of the invention provides a method of manufacturing an insulator for a corona igniter. The corona igniter includes the insulator and a shell surrounding a portion of the insulator and extending longitudinally from a shell upper end to a shell firing surface. The insulator is formed of an insulating material and extends longitudinally along a center axis to an insulator tip. The insulator has a thickness extending from an insulator outer surface to an insulator inner surface, the insulator inner surface presents a slot extending longitudinally along the center axis toward the insulator tip for containing a center electrode, and the insulator outer surface is round at the insulator tip. The step of providing the insulator includes providing the insulator so that the insulator thickness tapers between a location to be aligned with the shell firing surface and the insulator tip, and the insulator thickness does not increase between a start of the taper and the insulator tip.

According to an embodiment, the method includes reducing the insulator thickness at the insulator tip relative to the insulator thickness at the location to be aligned with the shell firing surface if a RATIO' defined by the following equation is less than or equal to 0:

$$RATIO' = \frac{R_{INS}}{CEP} - X$$

wherein $X=0.5007\times(R_{SHELL}-R_{INS})+0.5697$, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

Another aspect of the invention provides a method of manufacturing an insulator for a corona igniter. The corona igniter includes the insulator and a shell surrounding a portion of the insulator and extending longitudinally from a shell upper end to a shell firing surface. The insulator is formed of an insulating material and extends longitudinally along a center axis to an insulator tip. The insulator has a thickness extending from an insulator outer surface to an insulator inner surface, the insulator inner surface presents a slot extending longitudinally along the center axis toward the insulator tip for containing a center electrode, and the insulator outer surface is round at the insulator tip. The method includes increasing a length of the shell so that the shell firing surface is closer to the insulator tip if a RATIO' defined by the following equation is greater than or equal to 0:

$$RATIO' = \frac{R_{INS}}{CEP} - X$$

wherein $X=0.5007\times(R_{SHELL}-R_{INS})+0.5697$, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

Another aspect of the invention provides an internal combustion engine. The engine comprises an engine block including a top wall with an opening, and the engine block includes side walls extending from the top wall and forming a combustion chamber. A corona igniter is disposed in the opening of the cylinder head and extends into the combustion chamber. The corona igniter includes an insulator formed of an insulating material. The insulator extends longitudinally along a center axis to an insulator tip, the insulator has a thickness extending from an insulator outer surface to an insulator inner surface, the insulator inner surface presents a slot extending longitudinally along the center axis toward the insulator tip, and the insulator outer surface is round at the insulator tip. A central electrode is disposed in the slot of the insulator and extends longitudinally from an electrode upper end to an electrode tip, and the electrode tip being spaced from the insulator tip by the insulating material. A shell formed of metal surrounds a portion of the insulator and extends longitudinally from a shell upper end to a shell firing surface. The shell firing surface and a portion of the shell located above the shell firing surface is disposed in the combustion chamber.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 includes equations used to design the corona igniter assembly so that corona covers an insulator of the assembly and propagates to an insulator tip;

DETAILED DESCRIPTION OF EXEMPLARY EMBODIMENTS

Figure 1:
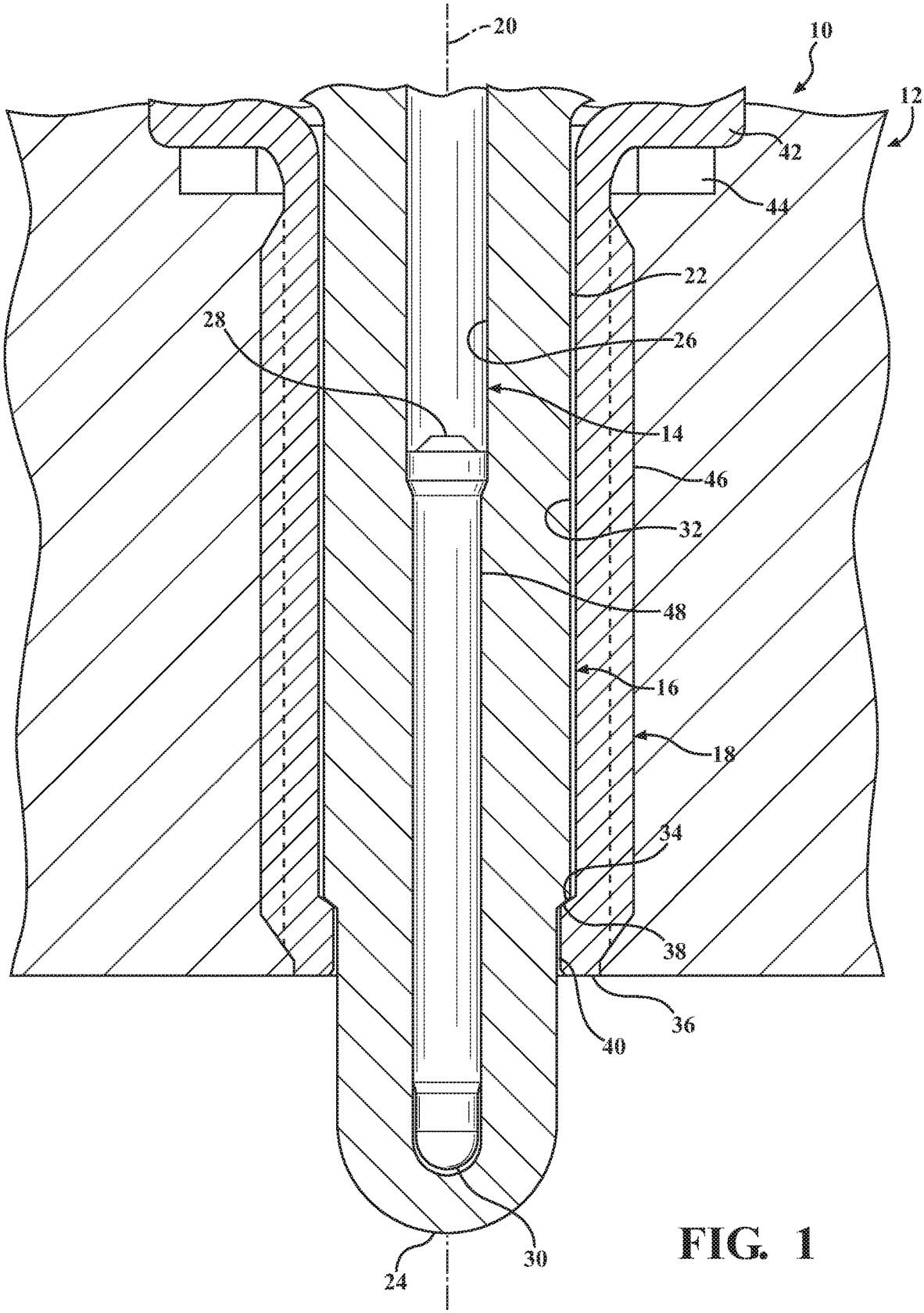
FIG. 1 is a cross-sectional view of a corona igniter assembly according to an example embodiment.

The invention provides a corona igniter 10 for an internal combustion engine 12. As shown in FIG. 1, the corona igniter generally includes a central electrode 14 formed of an electrically conductive metal surrounded by an insulator 16 formed of an insulating material, for example a ceramic material, such as alumina. The insulator is surrounded by a shell 18 formed of metal. The central electrode, insulator, and shell each extend longitudinally along a center axis 20 of the corona igniter.

The insulator presents an insulator outer surface 22 extending longitudinally along the center axis from an insulator upper end to an insulator tip 24. The insulator also includes an insulator inner surface 26 facing opposite the insulator outer surface and presenting a slot extending longitudinally along the center axis from the insulator upper end toward the insulator tip, but not entirely through the insulator tip. The insulator outer surface presents a concave surface at the insulator tip.

The central electrode is disposed in the slot of the insulator and extends longitudinally from an electrode upper end 28 to an electrode tip 30. The electrode tip is spaced from the insulator tip by the insulating material of the insulator.

Figure 2:
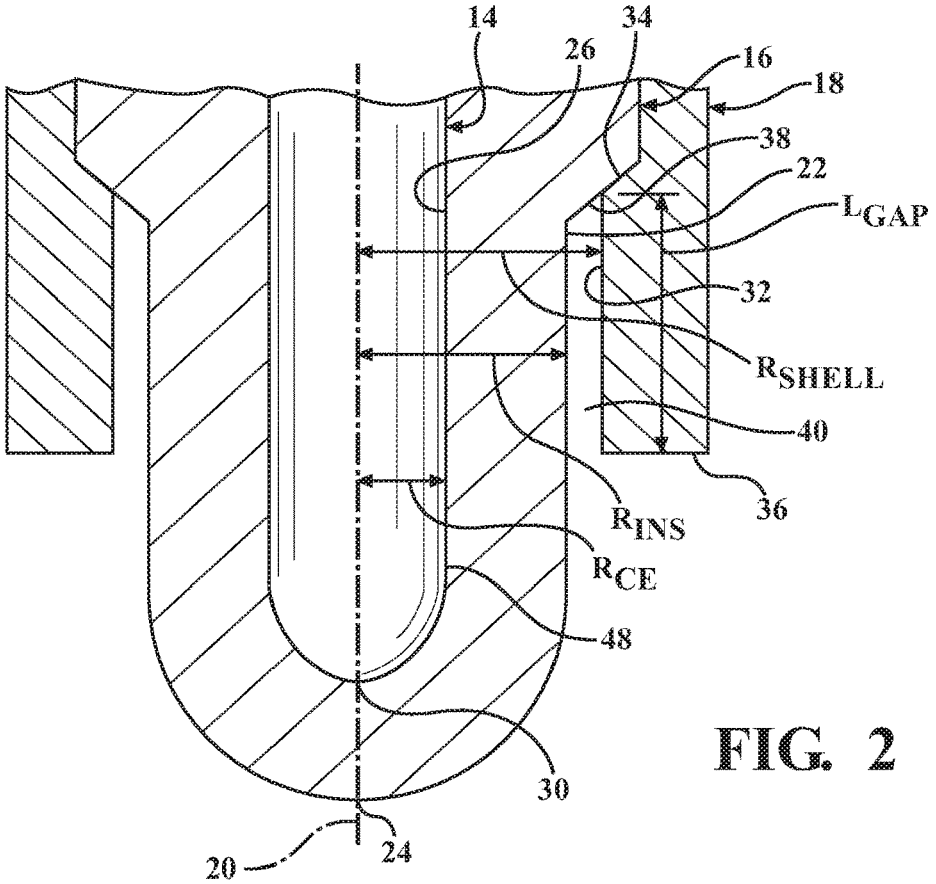
FIG. 2 is an enlarged cross-sectional view of a portion of a corona igniter assembly according to an example embodiment.
Figure 3:
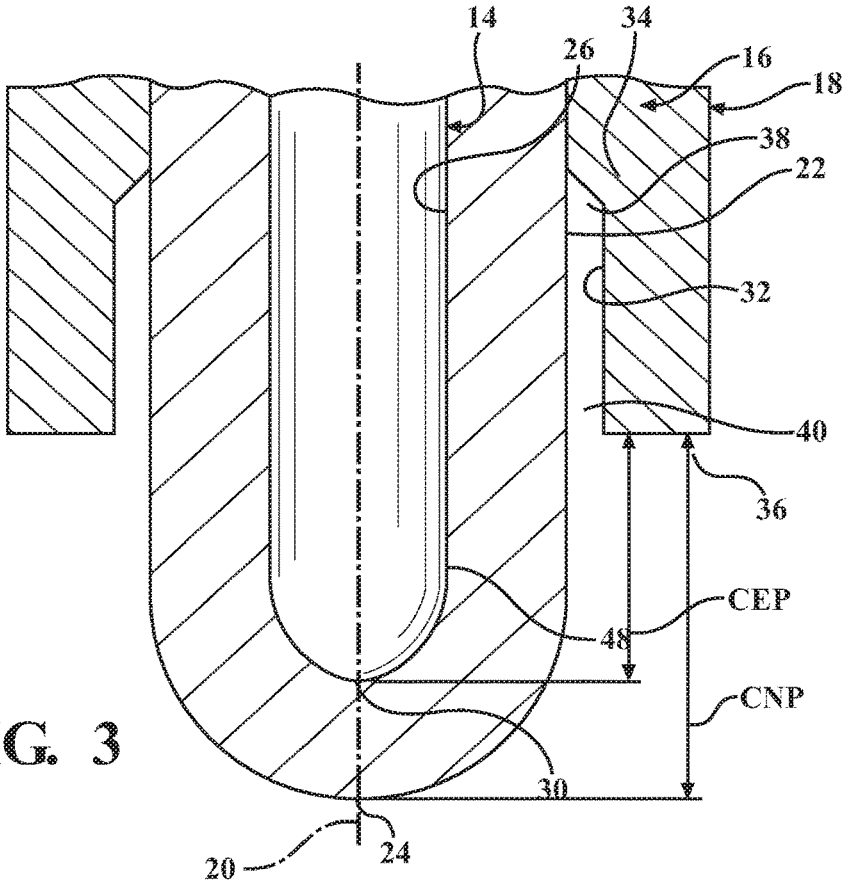
FIG. 3 is an enlarged cross-sectional view of a portion of a corona igniter assembly according to another example embodiment.

The shell includes a shell inner surface 32 facing the center axis, the shell inner surface includes a first section presenting a cylindrical shape surrounding the center axis. In the embodiments of FIGS. 1 and 2, an internal seat 34 extends from the first portion and at an angle relative to the center axis, and the shell inner surface includes a second section extending longitudinally from the internal seat to a shell firing face 36 and presenting a cylindrical shape surrounding the center axis. The insulator outer surface also includes an insulator lower shoulder 38 extending at an angle relative to the center axis and resting on the internal seat of said shell. Thus, a diameter presented by the shell inner surface decreases at the internal seat. As shown in FIG. 2, there is a shell gap 40 between the shell and the insulator. The shell gap extends longitudinally from the insulator lower shoulder to the shell firing face. In the embodiment of FIG. 3, the internal seat presented by the shell inner surface extends at an angle away from the insulator outer surface, such that a diameter presented by the shell inner surface increases, rather than decreases. Also in the embodiment of FIG. 3, the insulator includes no lower shoulder, and the shell gap extends from the internal seat of the shell to the shell firing face.

In the example of FIGS. 1 and 2, the shell includes a shell flange 42 which is disposed on an external gasket 44 that rests on a wall forming a combustion chamber of the engine. The shell flange extends radially relative to the center axis. The shell also includes a threaded region 46 extending longitudinally from the flange, and the threaded region includes a plurality of shell threads for engaging matching threads of the wall forming the combustion chamber.

Other examples of the corona igniter are shown in FIGS. 3 and 11-15. The corona igniter of this type is also referred to as a modified barrier discharge ignition (BDI) device. The corona igniter relies on a careful modification of the shape of the insulator to allow a greater area of corona to be produced with a lower voltage and power requirement than previous designs, while giving increased robustness against electrical and mechanical failure.

For the sizes of barrier discharge ignition (BDI) devices typically capable of installation into an engine, the highest electric field is usually formed where the insulator meets the grounded metal shell. The corona ignition described herein makes use of this high field by allowing corona formed in this area to propagate over the insulator outer surface towards the insulator tip. This propagation does not depend on the presence of a grounded shell around the projected part of the insulator and so allows maximum exposure of the combustible gas to the corona, improving ignition quality. This propagation is achieved by designing the insulator (in conjunction with the central electrode and shell design) such that the electric field, measured over the insulator outer surface is always of the correct polarity to encourage propagation. This is achieved by defining geometrical parameters which guarantee that corona can propagate freely. Where these parameters cannot be met due to other constraints, good performance may still be achieved by reducing the insulator thickness as it moves towards the insulator tip in a manner determined by a calculation of the voltage at the insulator outer surface. Designs of the corona igniter described herein will have maximum corona area over the insulator outer surface while keeping the maximum possible insulator thickness to avoid electrical or mechanical failure.

The example of the corona igniter shown in FIG. 1 is referred to as a "forward-assembled" design. In this case, the corona igniter is made by inserting the insulator tip through an upper end of the metal shell. The insulator is pushed against the shell by an upper shell feature (not shown). The insulator lower shoulder contacts the internal seat of the shell to form a gas-tight seal on the inside of the corona igniter assembly. However, alternative construction methods may be employed without changing the operation or applicability of this invention. For example, alternative methods are described in U.S. Pat. No. 9,088,136.

During use of the corona igniter in the combustion engine, the shell flange is disposed on the external gasket, and the external gasket is disposed on a mating surface forming the combustion chamber. The shell threads engage the matching threads in the wall of the engine so as to push the external gasket against the mating surface in the engine by means of the shell flange, thus creating a seal at the outer face of the corona igniter assembly.

According to one embodiment, the dimensions of the shell are chosen such that the shell firing face is largely coplanar with the wall of the combustion chamber. A high frequency, high voltage supply is connected to the central electrode and causes an electromagnetic field which propagates through insulator at all locations. This electric field can create a corona in any ionisable material, such as the air around the corona igniter, which is used to ignite the fuel-air mixture in the combustion chamber around the corona igniter. As there is no direct path for current from the central electrode to the grounded shell or to any other grounded component of the engine, arcing is avoided and therefore erosion of the electrode is avoided with a corresponding benefit for durability. In addition, there is no contact of combustion gasses with the central electrode, which removes corrosion as a source of electrode damage giving a further benefit.

FIG. 2 shows a detailed view of the region of the corona igniter exposed to the combustion chamber. Corona formation above the insulator lower shoulder is not desirable and steps are described elsewhere to prevent this in U.S. Pat. No. 8,839,753 (IA-41938), U.S. patent application Ser. No. 13/325,433 (IA-41945), and U.S. Pat. No. 8,278,808. In this case, the thickness of the insulator is constant in the region exposed to the combustion chamber from the shell firing surface to the insulator tip. The shell gap is filed with air and is designed to be the location of corona inception. This shell gap is bounded by the shell firing surface and the insulator lower shoulder in this forward assembly design, but may be bounded at the upper end by different features, depending on the construction method. For example, an intermediate part as described in U.S. Pat. No. 9,088,136 (IA-42324) or any brazed, welded or soldered construction (for example see FIG. 3) can be used to bind the shell gap. Several features of this shell gap help to improve performance for corona production. These features are described below.

Figure 5A:
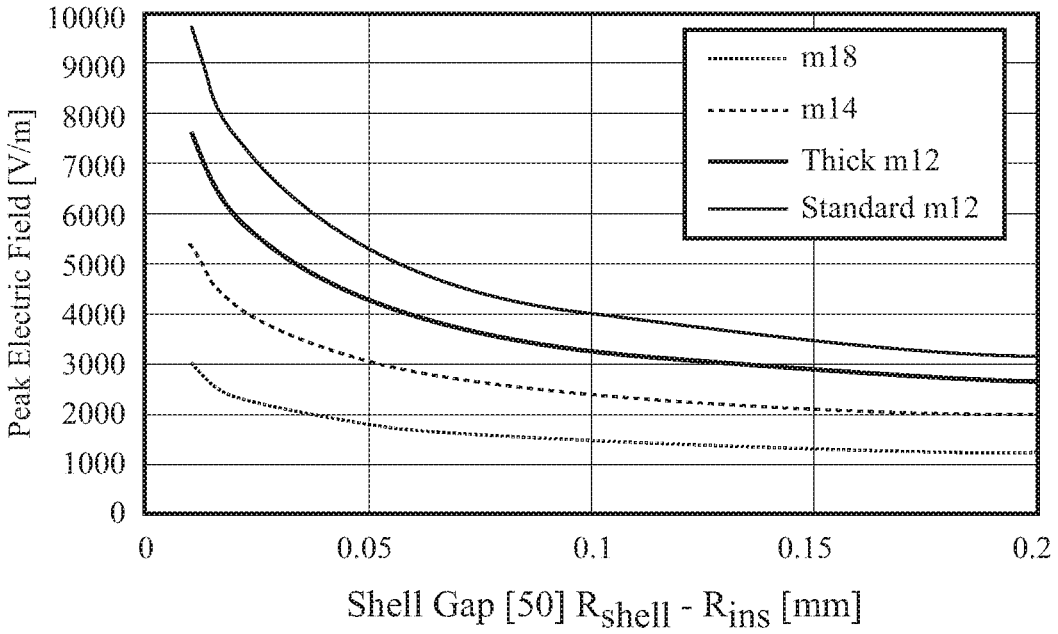
FIG. 5A shows how a gap between the insulator and shell of the corona igniter assembly effects electric field (and hence corona inception) for a range of typical igniter sizes.

The electric field in the shell gap varies according to equation 4.1 of FIG. 4. FIG. 5A shows how this gap effects electric field (and hence corona inception) for a range of typical igniter sizes. The gap should have a nominal size of at least 0.025 mm in width to avoid operating in the region below 0.02 mm where the change in field with gap becomes more rapid. The width of the shell gap is the distance from the insulator outer surface to the shell inner surface. This minimum size helps to ensure that any defects in surface finish do not have any uncontrollable effect on the electric field in gap and also to ensure that limits in concentricity of the parts do not cause the shell and the insulator to approach very closely in one or more regions at any location in the gap, which would lead to preferential corona formation at one side (undesirable).

A second feature that helps to improve performance is that the maximum size of the gap is set such that the electric field in this area is adequate for corona formation. Testing shows that a suitable electric field is at least 17 KV/mm at atmospheric temperature and pressure, rising with increasing gas density. It can be seen from FIG. 5A that larger igniter designs have a lower electric field, requiring a higher voltage to be applied, but that this can be offset by reducing the size of the gap to compensate. In igniters designed for automotive or industrial engines in common use, this graph and equation 4.1 show that this gives a realistic upper limit of 0.25 mm in width with the voltages available from current ignition systems.

Figure 5B:
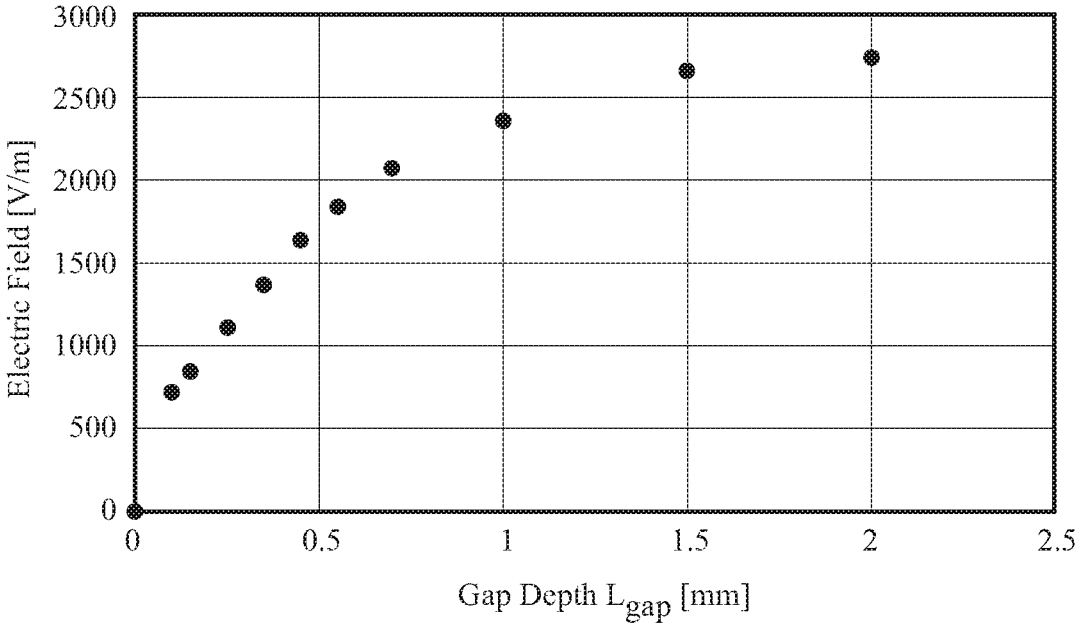
FIG. 5B shows representative example data giving the relationship between electric field in the gap and the depth of the gap.

A third feature that helps to improve performance is illustrated in FIG. 5B which shows representative example data giving the relationship between electric field in the gap and the depth of the gap L(Gap). The depth of the gap is the length extending longitudinally, parallel to the center axis of the corona igniter assembly, from an opening at the shell firing surface to a portion of the insulator or portion of the shell closing the gap. The depth of the gap L(Gap) should be minimum 1 mm and more optimally 1.5 mm deep. The maximum depth is controlled by thermal behavior but would not be more than 8 mm. Between 1.5 mm and 8 mm deep there is no electrical advantage, but a deeper gap may be desirable for thermal reasons in cases where the projection of the insulator must be low or the target engine rating is low.

In the example igniter shown in FIG. 2, corona formed in the shell gap will have a charge of the same sign as the shell and opposite sign to the central electrode, since opposite charge to the shell can, once formed by ionization, immediately flow into the conductive shell. Therefore, the corona will be attracted to the central electrode but its path will be blocked by the insulator. It will therefore tend to propagate towards the insulator tip, away from a repulsive charge on the shell; this will continue along the insulator outer surface until the electric field at the insulator outer surface is no longer favorable for further propagation. In general, this occurs either when the field reverses (which will stop further propagation completely) or the field gradient becomes so low that further propagation is not encouraged and becomes very slow.

Figure 6:
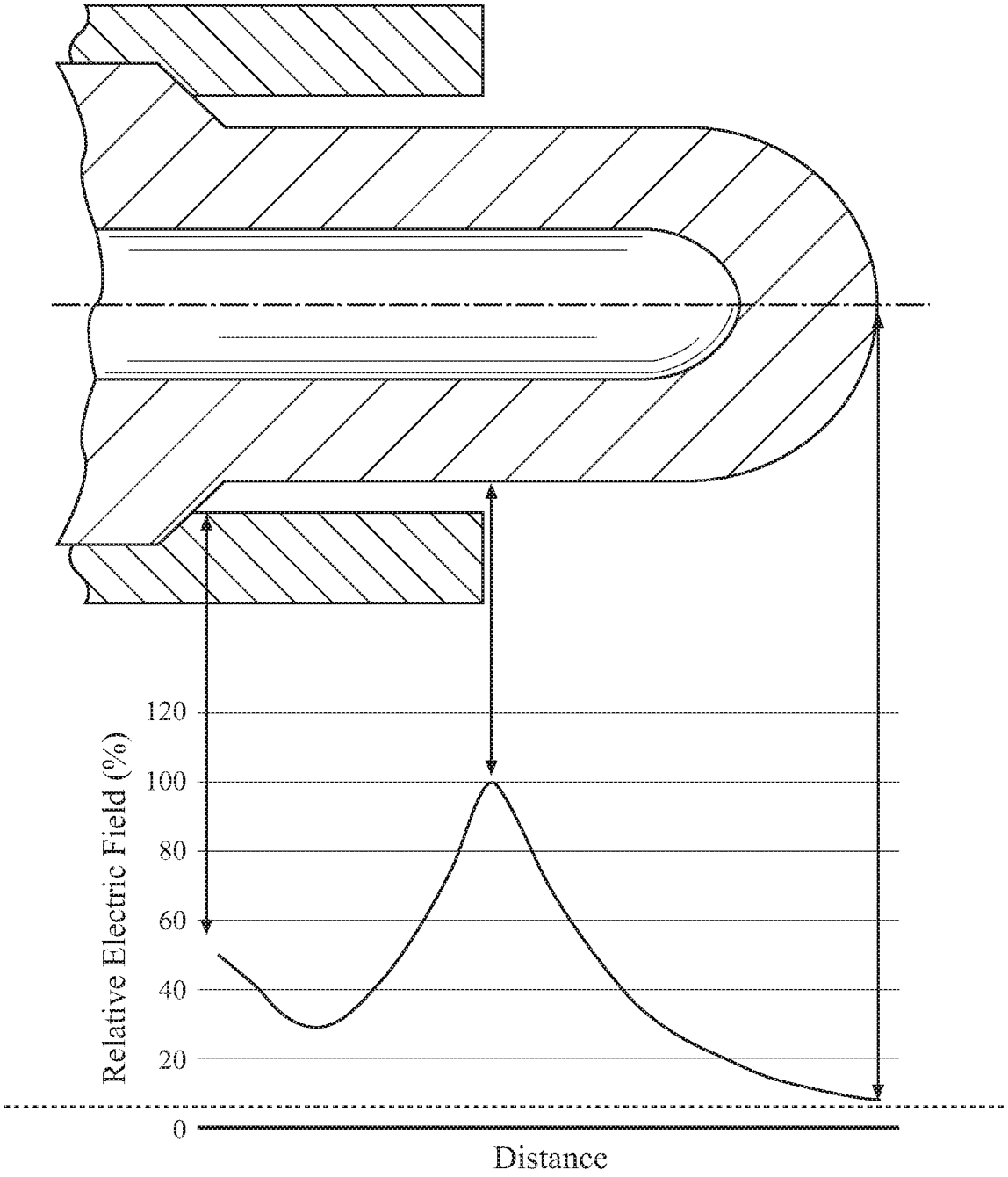
FIG. 6 shows an example of the electric field over the surface of the insulator according to an example embodiment.

FIG. 6 shows an example of the electric field over the insulator outer surface, where this insulator has equal thickness in the exposed region between the shell firing surface and the insulator tip. The design creates a peak in the shell gap adjacent to the shell firing surface where the corona can easily form. The gradient of the field encourages the corona to propagate towards the insulator tip. In this case, the field is always higher than the critical value (dashed line) so the corona can propagate fully to the insulator tip. However, it may be seen that a longer insulator or a different arrangement of the geometry can lead to the electric field falling below the critical value and hence corona not fully cover the insulator. Testing has shown that this occurs when the electric field falls below a critical value of 40 KV/m (alumina ceramic at room temperature and pressure). Using this limit, the likely distance of propagation over the surface for any design of BDI igniter can be analyzed.

Referring again to FIGS. 2 and 3, virtual experiments were completed to assess the propagation of corona with varying radii of the central electrode $R_{CE}$, the insulator $R_{INS}$, and the shell $R_{SHELL}$, and different lengths for the central electrode projection CEP and core nose projection CNP, measured in areas with a constant insulator thickness. The central electrode radii $R_{CE}$ is the distance from the center axis to an electrode outer surface 48, the insulator radii $R_{INS}$ is the distance from the center axis to the insulator outer surface, and the shell radii $R_{SHELL}$ is the distance from the center axis to the shell inner surface. The central electrode projection CEP is the distance between the shell firing surface and the bottom of the electrode tip. The core nose projection CNP is the distance between the shell firing surface and the insulator tip.

Figure 7:
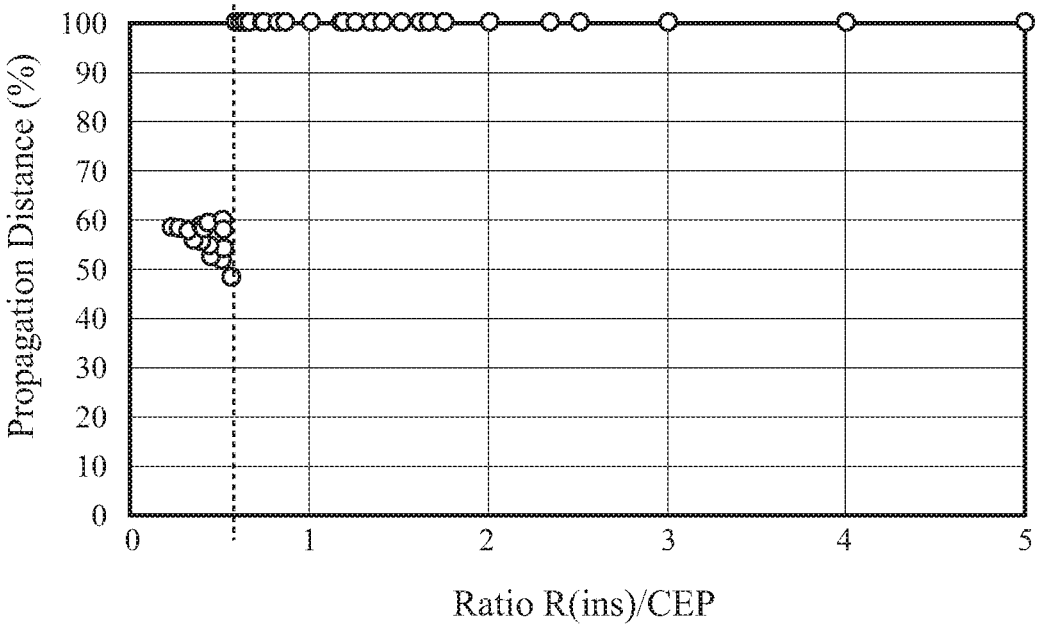
FIG. 7 shows the corona propagation distance related to the insulator geometry in the case where the shell gap is zero (transition value)

FIG. 7 shows the propagation distance for these studies in the case where the shell gap is zero (the simplest case). In this case the x-axis is the insulator radii $R_{INS}$ divided by the projection of the central electrode, $R_{INS}$/CEP (equation 4.2 in FIG. 4). This parameter is non-dimensional and applies to igniters at every scale. For all geometries where the diameter of the central electrode projection CEP is less than about half of the diameter of the insulator, corona will propagate to the insulator tip. Hence we can see that all geometries where this ratio is above a transition value will have good performance with a fixed insulator thickness.

Figure 8:
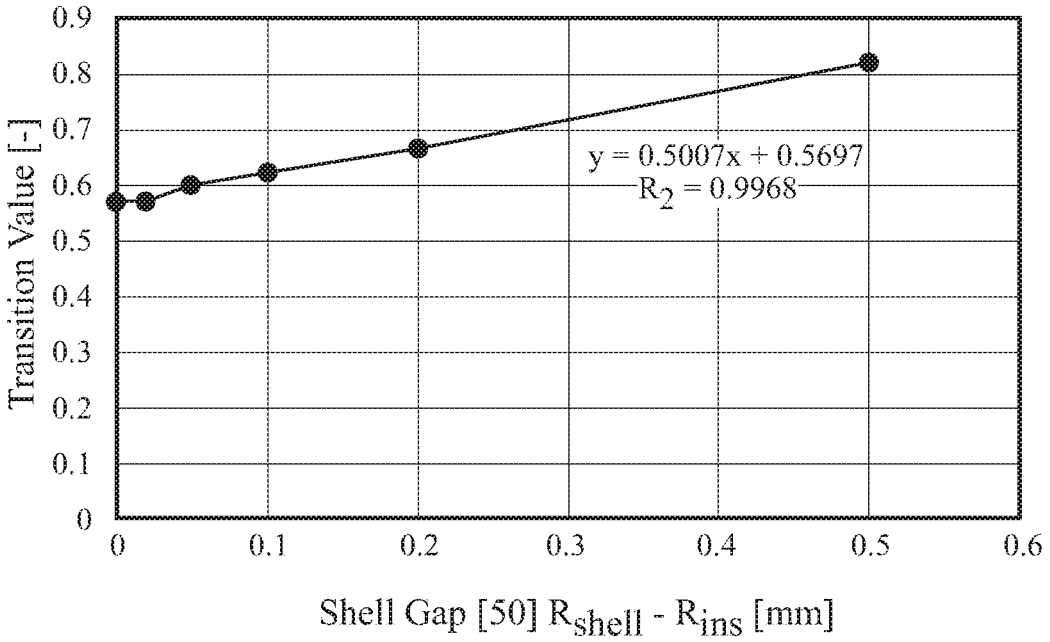
FIG. 8 shows how the transition value changes over a range of sizes of shell gaps.
Figure 9:
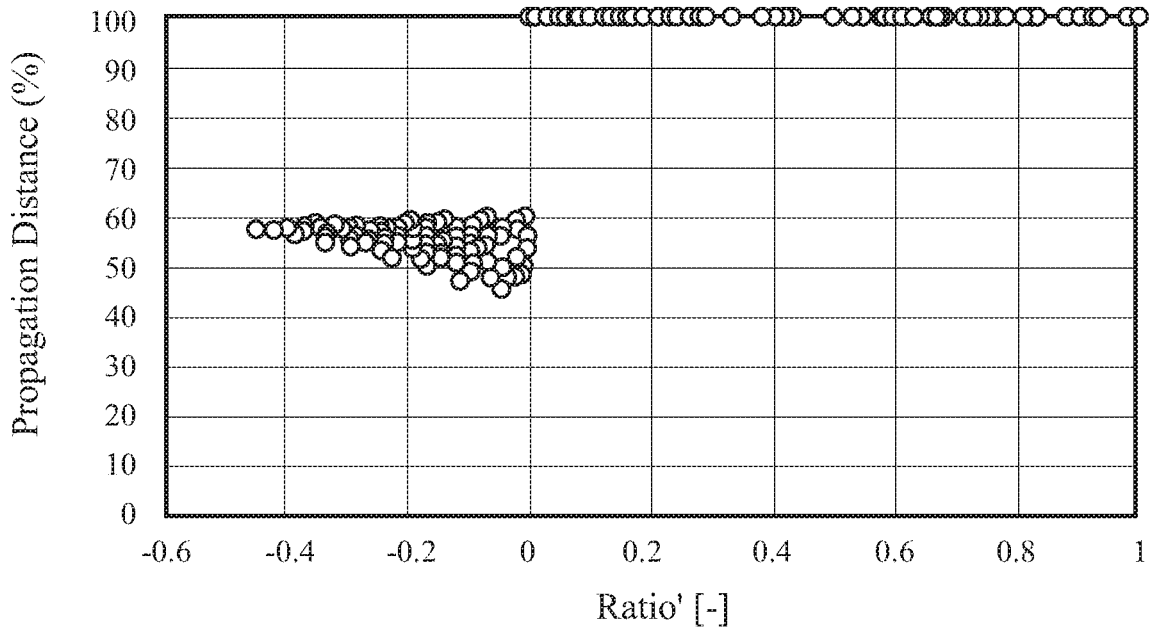
FIG. 9 illustrates corona propagation distance related to insulator geometry, including the effect of the shell gap.
Figure 10:
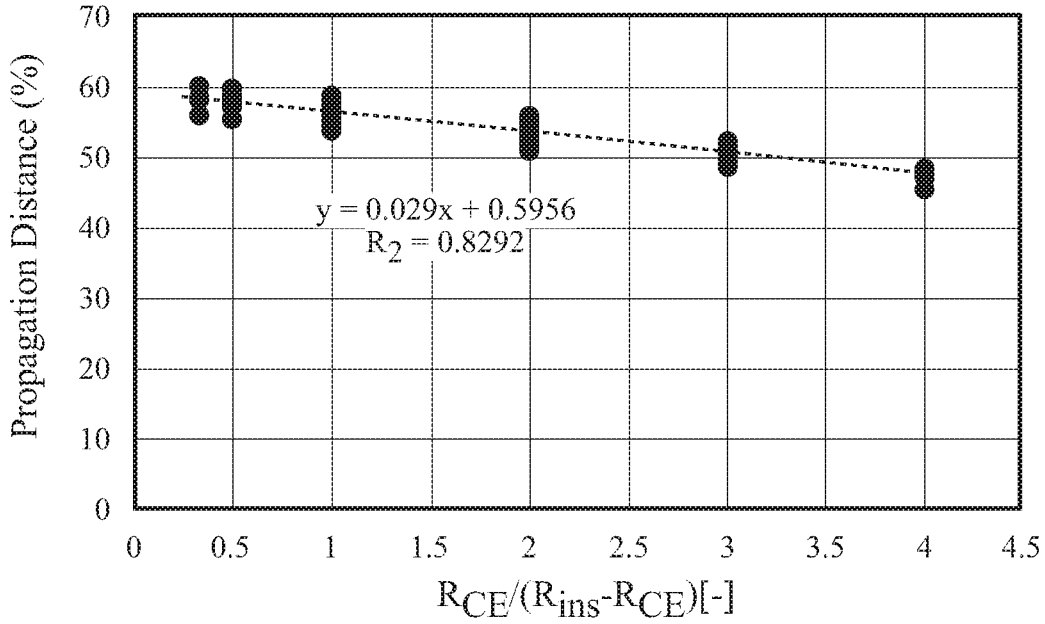
FIG. 10 illustrates corona propagation distance for cases where the corona does not reach the insulator tip.

The transition value in FIG. 7 is for the case where the shell gap is zero i.e. $R_{SHELL}=R_{INS}$, which would enforce the condition that the voltage at the insulator outer surface adjacent to the shell firing face would be zero (the shell voltage). In corona igniters used in internal combustion engines, this gap is critical and may not be neglected. Variation of the voltage across the gap of the igniters is described by equation 4.3 in FIG. 4. A larger voltage here leads to a correspondingly lower voltage across the insulator at the location of the shell firing surface which has a similar effect to changing the length of the ignitor CEP and CNP. The result is a modification to the transition value. FIG. 8 shows how this value changes over a range of sizes of gaps where the shell gap=$R_{SHELL}-R_{INS}$. Note that this line depends on the absolute size of the shell gap as it is based on manufacturing restrictions which do not scale equally with size, and is therefore only applicable for igniters having an insulator diameter in the range 3 mm to 15 mm at the shell firing surface. Outside this range, the data would need to be scaled according to the size of the geometry, although the linear form observed implies wider applicability than noted here. So the transition value X may be described by equation 4.4 on FIG. 4. A new ratio may be defined, RATIO', which is offset by this value X so that the transition value is always zero (equation 4.5). FIG. 9 shows how the virtual results fit with the proposed formula. Thus, any igniter with a value of RATIO' in equation 4.5 greater than zero will have corona propagation to the tip and therefore is well designed. Clearly, a margin of safety is required in the design to account for, for example: manufacturing tolerances, differences in operating conditions, differences in surface finish or the presence of deposits on the insulator outer surface. It is good design practice to assume that the corona might propagate less than the distance described by equation 4.4 and therefore to modify the design with this in mind. In practice, this may be achieved by increasing the value of X by 10% before making the test of RATIO'<zero.

Considering the parts of the igniter where corona does not propagate to the insulator tip, it may be calculated how far the propagation will occur for BDI igniters with an insulator of constant thickness. This distance (as a percentage Y of the Corenose Projection CNP) is well described by the equation of 4.6, depending on the ratio of central electrode radius to insulator thickness (insulator radius $R_{INS}$ minus central electrode radius $R_{CE}$). This parameter is scale-independent. Now, the corona can be encouraged to propagate further, where equation 4.5 gives a negative value of ratio (but see note above about 10% margin) which indicates that a modification is needed, by reducing the insulator thickness towards the insulator tip, where the taper starts at or before the location given by equation 4.6. The insulator thickness does not increase between the start of the taper and the insulator tip. Typically, the insulator thickness also does not increase between the shell firing surface and the insulator tip. However, in the embodiment of FIG. 15, the insulator thickness increases outside of the shell before tapering in a direction moving toward the insulator tip. In order to be effective, the taper must be unidirectional (i.e. the thickness reduces on average and never locally increases in a direction towards the insulator tip), but the rate of reduction need not be fixed. From the start of the taper to the insulator tip, the average reduction in the insulator thickness should be greater than or equal to a percentage of the insulator thickness at the start of the taper given by the following equation.

$$T\%=30.3\%-(45.2\%*P1)-(0.8\%*P2)+(4.2\%*P3)+2.5\% \quad \text{(equation 4.7)}$$

The value T % is a predicted taper, which should be at least as much as the actual taper required to achieve the good corona propagation. The parameters P1, P2, and P3 are taken from equations 4.2, 4.3, and 4.6 as follows:

$$P1=\frac{R_{INS}}{CEP}$$

$$P2=\left(\frac{R_{CE}}{R_{INS-R_{CE}}}\right)$$

$$P3=\frac{\ln\left(\frac{R_{SHELL}}{R_{INS}}\right)}{\ln\left(\frac{R_{INS}}{R_{CE}}\right)}$$

Figure 16:
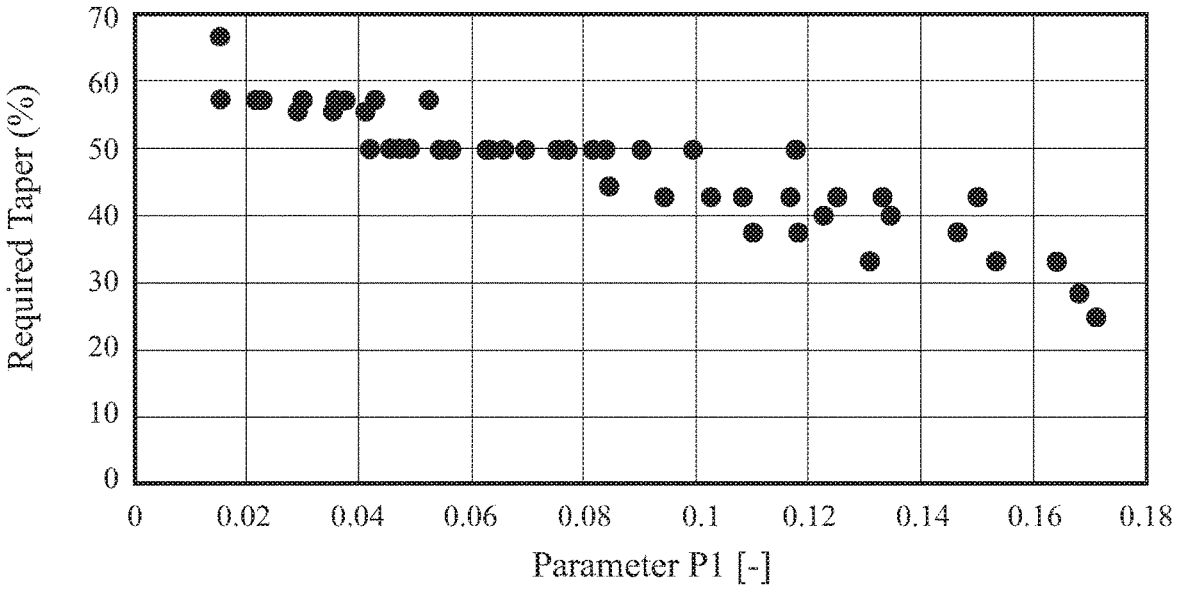
FIG. 16 is a graph showing the taper required to achieve the good corona propagation.

FIG. 16 shows the taper required to achieve the good corona propagation. The three parameters above need to be introduced to fit the above data more accurately.

Figure 17:
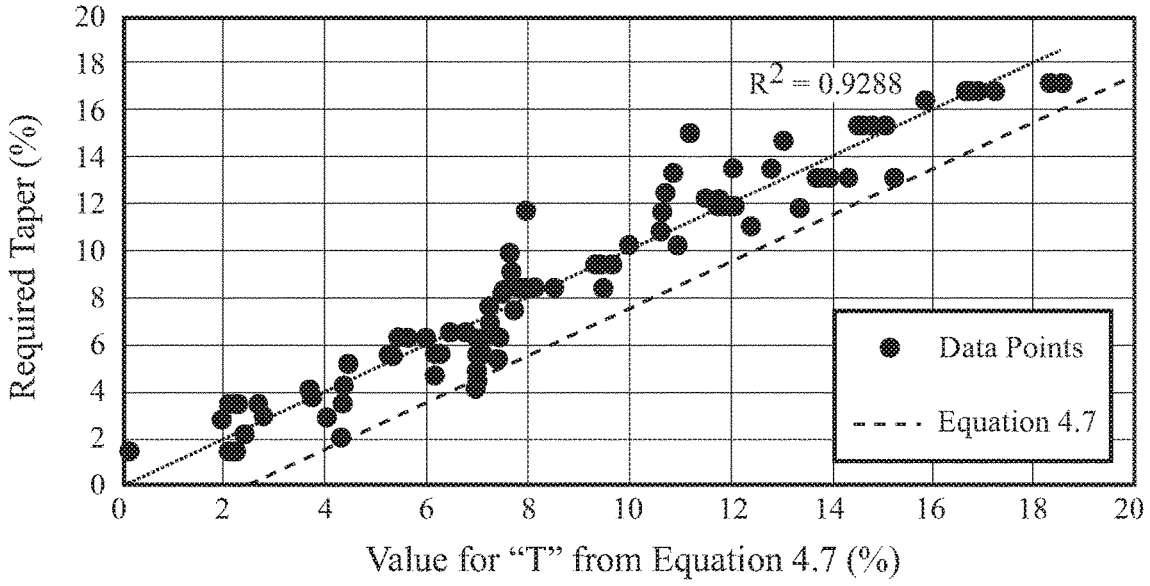
FIG. 17 is a graph showing all the data points and the required taper for each (vertical axis), and the best-fit line through these data points.

FIG. 17 shows all the data points and the required taper for each (vertical axis), and the best-fit line through these data points. The line showing equation 4.7 shows that all the data points require a taper equal to or less than the value from equation 4.7, that is: taper is at least enough in all cases to get good corona propagation.

In summary, equation 4.7 provides a predicted taper value, which helps to predict the amount of taper (reduction in insulator thickness between the start of the taper and the insulator tip) required for the desired corona propagation. For example, if the insulator thickness is 1 mm at the start of the taper, and the required taper (reduction in thickness of the insulator) is at least 10%, then the insulator thickness at the insulator tip should be at not greater than 0.9 mm.

Figure 11:
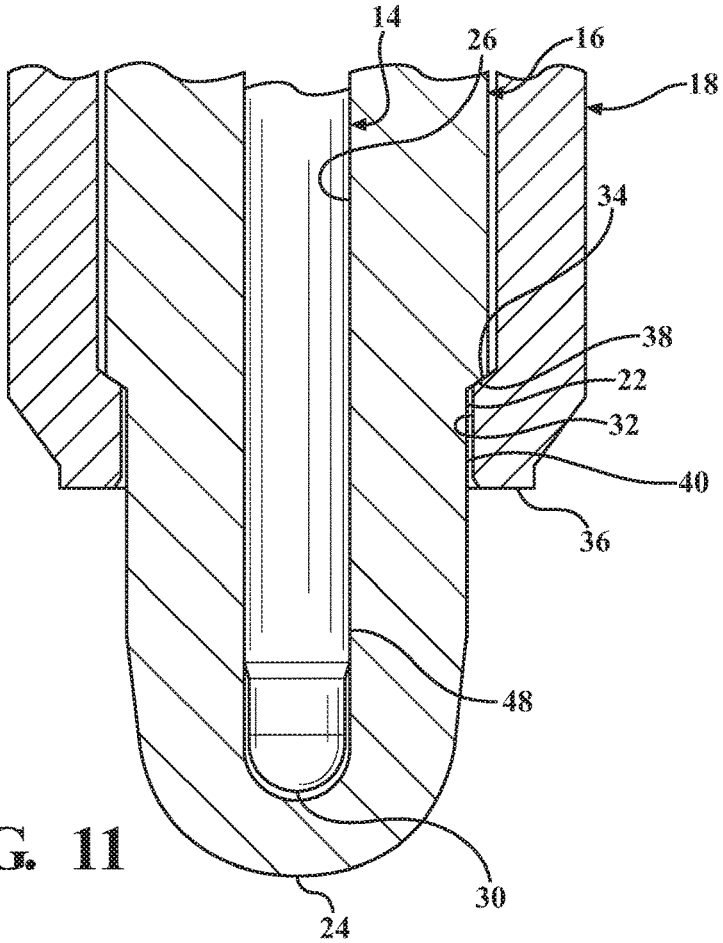
FIGS. 11-15 are enlarged cross-sectional views of portions of corona igniter assemblies according to other example embodiments.

FIG. 11 shows an exemplary corona igniter. In this case, the equation of 4.5 is less than zero, indicating that corona will not propagate to the insulator tip if the thickness of the insulator is constant over the outer surface of the insulator in the area of the core nose projection CNP. As a design target, the insulator thickness should be tapered as little as possible to ensure sufficient electrical and mechanical strength at the insulator tip. To achieve this, the insulator includes a cylindrical section extending from shell firing surface at point A up to a point B where the taper starts. This is defined by equation 4.6 which gives a location (as a proportion of the total Corenose Length CNL) by/before which the taper must begin. Equation 4.6 defines distance Y which is AB on this figure. In this example, a conical section is tangential with a spherical tip at point C. A spherical section has inner and outer surfaces which may be spherical or some other shape, providing the thickness decreases at all points when moving from point C to the insulator tip at point O. In the case of spherical surfaces, this means that the inner and outer spheres do not share a common central point.

Figure 12:
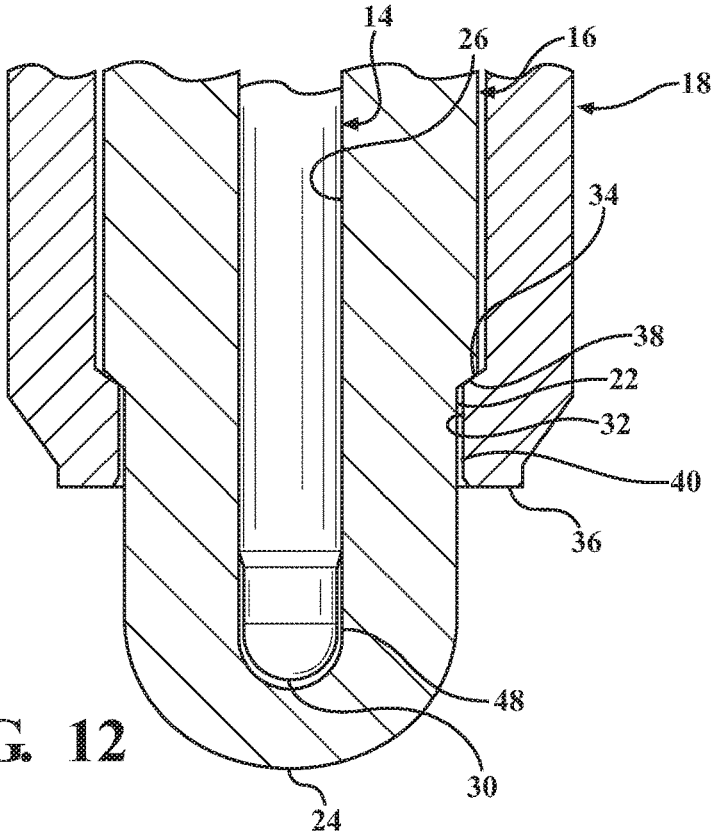

FIG. 12 shows another exemplary embodiment. In this case, the shorter insulator gives a value of Y from equation 4.6 such that there is no requirement for the conical section previously employed. In this case, the tapered section starts at the spherical section at point C. The inner and outer spherical surfaces at the insulator tip are not concentric, allowing the insulator to be thinner at point O than at point C.

Figure 13:
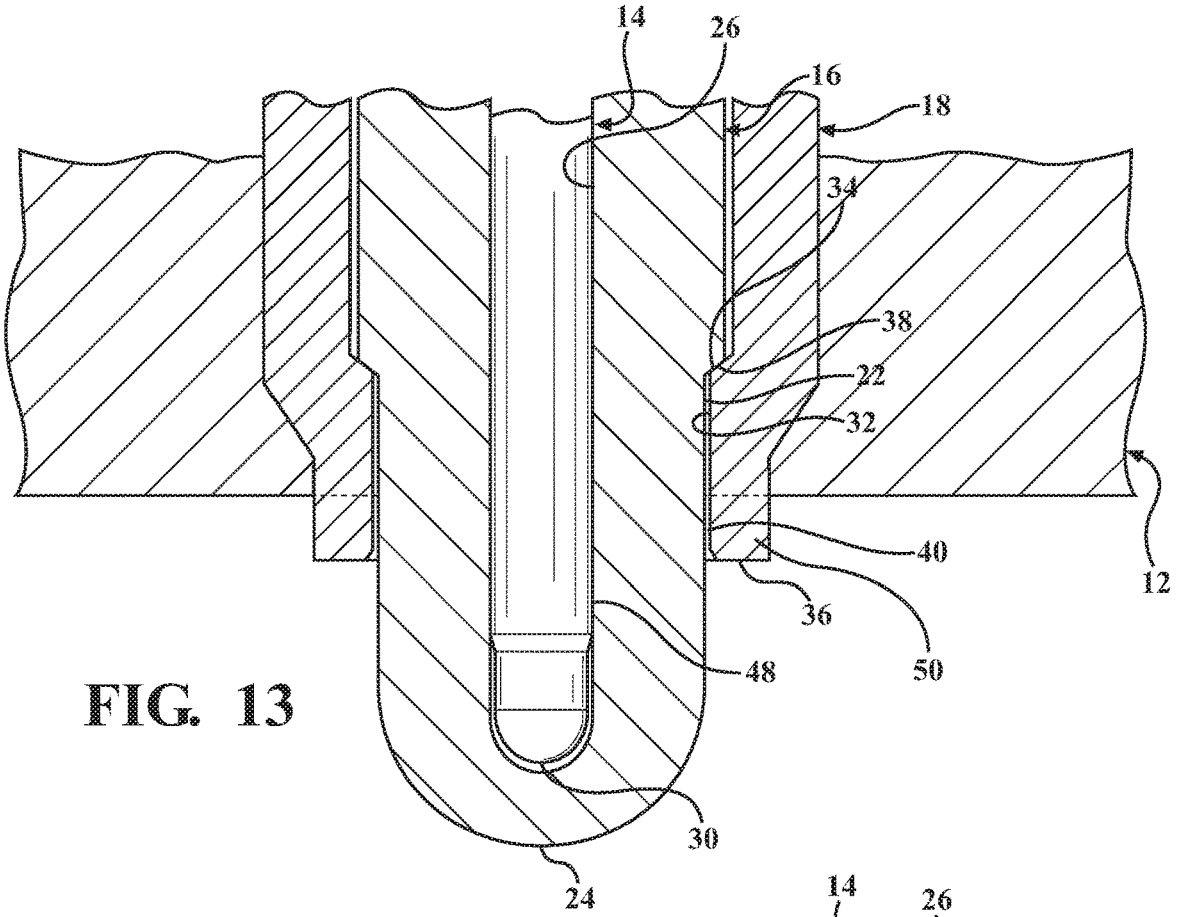

FIG. 13 shows an alternative solution which may be combined with this method described above. In this case, the shell is extended by a skirt 50 projecting out into the combustion chamber. This has the effect of making the effective geometry of the insulator shorter and changing the RATIO' (equation 4.5) such that a taper is no longer required, or changing the value of Y(equation 4.6) such that the percentage of the insulator requiring a taper is reduced. Either case has the desirable result that the corona propagation is good while maintaining the maximum thickness at all locations.

Additional embodiments of the invention, as well as background information relative to the invention, is provided in the accompanying paper titled "New Developments and Optimization of The Advanced Corona Ignition System (ACIS)." Section 4 of the paper, titled "Alternative Solution: BDI" is especially relevant. FIG. 24 of Section 4 illustrates three example igniter designs. In FIG. 24, the top dotted line indicates the location of the ledge of the engine upon which a gasket rests. The middle dotted line indicates the opening to the combustion chamber, and the igniter is exposed to the combustion chamber in the region below the middle dotted line. The lowest dotted line indicates the location of the tip of the insulator. The design on the left of FIG. 24 shows an unoptimized design. The design in the middle of FIG. 24 illustrates a design with a shell skirt, wherein the shell extends outwardly of the opening and is exposed in the combustion chamber. The design on the right of FIG. 24 illustrates a design with the insulator tapered so that the insulator has a reduced thickness between the start of the taper and the tip.

Figure 14:
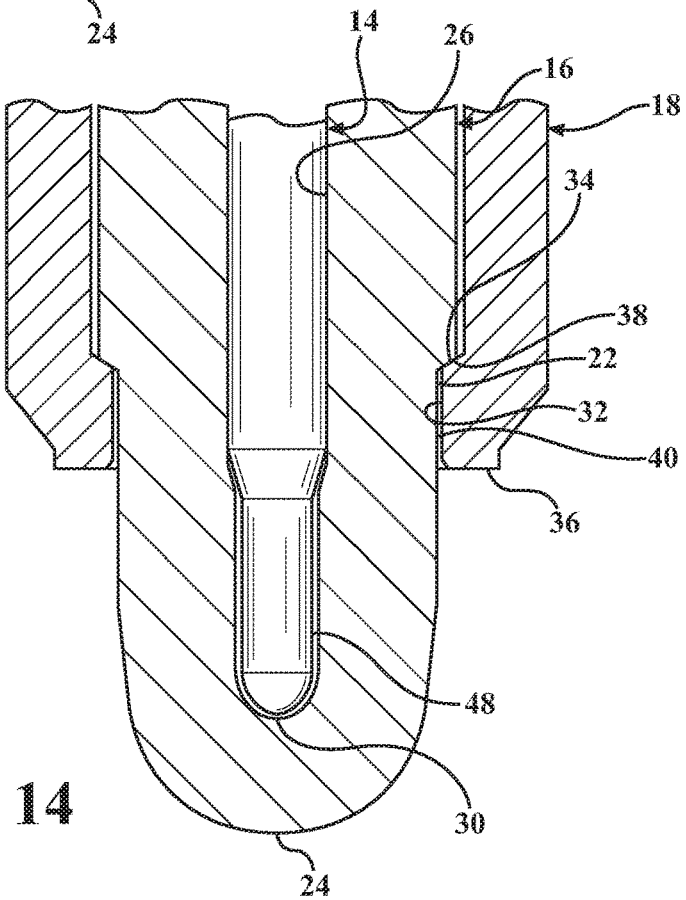
Figure 15:
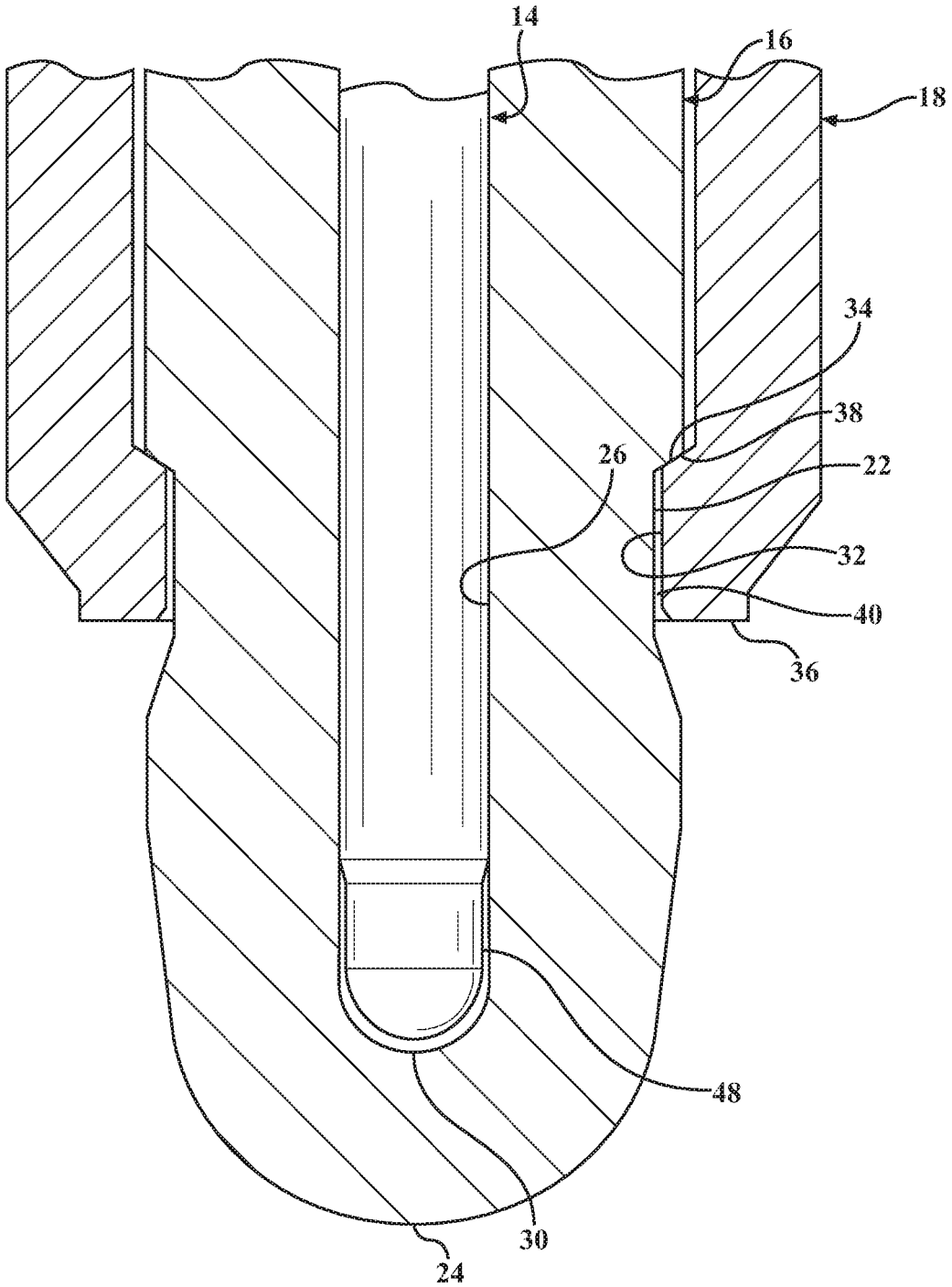

Considering FIG. 6 again, it can be seen that the electric field over the outer surface of the insulator is high and in the correct direction as the insulator emerges from the metal shell. The high field can be advantageously used by allowing the insulator to become thicker in this region in a direction towards the firing end tip. This will reduce the electric field in this region, but can be arranged to still be sufficiently positive for good electrical performance. Two different schemes to implement this are shown in FIGS. 14 and 15. In FIG. 15, the insulator thickness increases at the shell firing surface in a direction moving toward the insulator tip before taping. This is unlike the other embodiments wherein the insulator thickness does not increase between the shell firing surface and the insulator tip. These schemes may be applied to igniters with or without a shell skirt, with or without a reduction in the tip diameter of the central electrode, with forward or reverse or barbell assembled igniter, etc. The benefit of these designs is that the tip may be made thicker while still maintaining good corona propagation.

In summary, the new method described herein can determine if any given igniter design will allow corona propagation to the insulator tip, covering the entire insulator outer surface and allowing best performance. If corona will not cover the insulator, a taper to the insulator thickness may be added which starts at or before a specific location depending on the geometry of the igniter which is described above. After beginning to taper, the taper in the thickness of the insulator is unidirectional from the start of taper to the insulator tip, and the amount of the taper is also described in this disclosure. This combination allows the minimum thickness of the insulator to be optimized for best mechanical and electrical performance.

Obviously, many modifications and variations of the present invention are possible in light of the above teachings and may be practiced otherwise than as specifically described while within the scope of the invention. It is contemplated that all features described and of all embodiments can be combined with each other, so long as such combinations would not contradict one another.

What is claimed is:

1. A corona igniter, comprising:

an insulator formed of an insulating material, said insulator extending longitudinally along a center axis from an insulator upper end to an insulator tip, said insulator having a thickness extending from an insulator outer surface to an insulator inner surface, said insulator inner surface presenting a slot extending longitudinally along said center axis from said insulator upper end toward said insulator tip, and said insulator outer surface being round at said insulator tip;

a central electrode disposed in said slot of said insulator and extending longitudinally from an electrode upper end to an electrode tip, said electrode tip being spaced from said insulator tip by said insulating material;

a shell formed of metal surrounding a portion of said insulator and extending longitudinally from a shell upper end to a shell firing surface;

said insulator thickness tapering between said shell firing surface and said insulator tip, and said insulator thickness not increasing between a start of the taper and said insulator tip, said insulator including a core nose projection having a length extending from said shell firing surface to said insulator tip, said taper in said insulator thickness extending along a percentage of said length of said core nose projection, and said percentage of said length being greater than or equal to a calculated percentage defined according to the following equation:

$$Y = -2.9\% \times \left(\frac{R_{CE}}{R_{INS} - R_{CE}}\right) + 59.56\%$$

wherein Y is said percentage of said length of said core nose projection of said insulator, $R_{CE}$ is a radius of said center electrode, said radius of said center electrode is a distance extending from said center axis to an electrode outer surface, and $R_{INS}$ is a radius of said insulator, said radius of said insulator is a distance extending from said center axis to said insulator outer surface, and said radius of said insulator is measured along a portion of said insulator wherein said insulator thickness is constant.

2. A corona igniter according to claim 1, and said insulator outer surface extends radially inwardly toward said insulator inner surface to present said taper in said insulator thickness.

3. A corona igniter, comprising:

an insulator formed of an insulating material, said insulator extending longitudinally along a center axis from an insulator upper end to an insulator tip, said insulator having a thickness extending from an insulator outer surface to an insulator inner surface, said insulator inner surface presenting a slot extending longitudinally along said center axis from said insulator upper end toward said insulator tip, and said insulator outer surface being round at said insulator tip;

a central electrode disposed in said slot of said insulator and extending longitudinally from an electrode upper end to an electrode tip, said electrode tip being spaced from said insulator tip by said insulating material;

a shell formed of metal surrounding a portion of said insulator and extending longitudinally from a shell upper end to a shell firing surface;

said insulator thickness tapering between said shell firing surface and said insulator tip, and said insulator thickness not increasing between a start of the taper and said insulator tip, wherein said insulator thickness is constant along a first portion of said insulator and tapers along a second portion of said insulator extending from said first portion toward said insulator tip, said insulator thickness at said insulator tip relative to said insulator thickness at said first portion being reduced by greater than or equal to a percentage of said insulator thickness at said first portion, said percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS-R_{CE}}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of said insulator thickness at said first portion, $R_{INS}$ is a radius of said insulator, said radius of said insulator is a distance extending from said center axis to said insulator outer surface, and said radius of said insulator is measured along a portion of said insulator wherein said insulator thickness is constant, CEP is a distance between said shell firing surface and said electrode tip, $R_{CE}$ is a radius of said center electrode, said radius of said center electrode being a distance extending from said center axis to an electrode outer surface, and $R_{SHELL}$ is a radius of said shell, said radius of said shell being a distance extending from said center axis to a shell inner surface at said shell firing surface.

4. A corona igniter according to claim 1, wherein said insulator thickness is constant along a first portion of said insulator and tapers continuously along a second portion of said insulator extending from said first portion to said insulator tip.

5. A corona igniter according to claim 1, wherein said insulating material is alumina, said shell includes a flange extending radially outwardly from said center axis and a threaded region extending longitudinally from said flange, said threaded region includes a plurality of threads, said shell includes a shell inner surface facing said center axis, said shell inner surface includes a first section presenting a cylindrical shape surrounding said center axis, said shell inner surface includes an internal seat extending from said first section and at an angle relative to said center axis, said inner surface includes a second section extending longitudinally from said internal seat to said shell firing surface and presenting a cylindrical shape surrounding said center axis, said insulator outer surface including an insulator lower shoulder extending at an angle relative to said center axis and resting on said internal seat of said shell, said shell and said insulator presenting a gap therebetween, and said gap extending from said insulator lower shoulder to said shell lower end.

6. An insulator for a corona igniter, the corona igniter including a center electrode for receipt in a slot of said insulator and a shell for surrounding said insulator, said insulator being formed of an insulating material and extending longitudinally along a center axis from an insulator upper end to an insulator tip, said insulator having a thickness extending from an insulator outer surface to an insulator inner surface, said insulator inner surface presenting a slot extending longitudinally along said center axis from said insulator upper end toward said insulator tip, and said insulator outer surface being round at said insulator tip;

said insulator thickness tapering between said insulator tip and a location to be longitudinally aligned with a shell firing surface of said shell, and said insulator thickness not increasing between a start of said taper and said insulator tip;

said insulator including a core nose projection for extending from said shell firing surface to said insulator tip, said insulator thickness tapering along said core nose projection, said taper in said insulator thickness extending along a percentage of said length of said core nose projection, and said percentage of said length being greater than or equal to a calculated percentage defined according to the following equation:

$$Y = -2.9\% \times \left(\frac{R_{CE}}{R_{INS} - R_{CE}}\right) + 59.56\%$$

wherein Y is said percentage of said length of said core nose projection of said insulator, $R_{INS}$ is a radius of said insulator, said radius of said insulator is a distance extending from said center axis to said insulator outer surface, and said radius of said insulator is measured along a portion of said insulator wherein said insulator thickness is constant, and $R_{CE}$ is a radius of said insulator, said radius of said insulator is a distance extending from said center axis to said insulator outer surface, and said radius of said insulator is measured along a portion of said insulator wherein said insulator thickness is constant.

7. An insulator for a corona igniter, the corona igniter including a center electrode for receipt in a slot of said insulator and a shell for surrounding said insulator, said insulator being formed of an insulating material and extending longitudinally along a center axis from an insulator upper end to an insulator tip, said insulator having a thickness extending from an insulator outer surface to an insulator inner surface, said insulator inner surface presenting a slot extending longitudinally along said center axis from said insulator upper end toward said insulator tip, and said insulator outer surface being round at said insulator tip;

said insulator thickness tapering between said insulator tip and a location to be longitudinally aligned with a shell firing surface of said shell, and said insulator thickness not increasing between a start of said taper and said insulator tip, wherein said insulator thickness is constant along a first portion of said insulator and tapers along a second portion of said insulator extending from said first portion toward said insulator tip, said insulator thickness at said insulator tip relative to said insulator thickness at said first portion is reduced by greater than or equal to a percentage of said insulator thickness at said first portion, said percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS-R_{CE}}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of said insulator thickness at said first portion, $R_{INS}$ is a radius of said insulator, said radius of said insulator is a distance extending from said center axis to said insulator outer surface, and said radius of said insulator is measured along a portion of said insulator wherein said insulator thickness is constant, CEP is a distance between said shell firing surface and said electrode tip, $R_{CE}$ is a radius of said center electrode, said radius of said center electrode being a distance extending from said center axis to an electrode outer surface, and $R_{SHELL}$ is a radius of said shell, said radius of said shell being a distance extending from said center axis to a shell inner surface at said shell firing surface.

8. An insulator according to claim 6, wherein said insulator thickness tapers between said shell firing surface and said insulator tip, and said insulator outer surface extends radially inwardly toward said insulator inner surface to present said taper in said insulator thickness.

9. An insulator according to claim 6, wherein said insulator thickness does not increase between the location to be longitudinally aligned with said shell firing surface of said shell and said insulator tip.

10. A method of manufacturing a corona igniter, comprising the steps of:

providing an insulator formed of an insulating material, the insulator extending longitudinally along a center axis from an insulator upper end to an insulator tip, the insulator having a thickness extending from an insulator outer surface to an insulator inner surface, the insulator inner surface presenting a slot extending longitudinally along the center axis from the insulator upper end toward the insulator tip, the insulator outer surface being round at the insulator tip;

providing a central electrode disposed in the slot of the insulator and extending longitudinally from an electrode upper end to an electrode tip, the electrode tip being spaced from the insulator tip by the insulating material;

providing a shell formed of metal surrounding a portion of the insulator and extending longitudinally from a shell upper end to a shell firing surface;

the step of providing the insulator including providing the insulator so that the insulator thickness tapers between the shell firing surface and the insulator tip, and the insulator thickness does not increase between a start of the taper and the insulator tip; and reducing the insulator thickness at the insulator tip relative to the insulator thickness at the shell firing surface if a RATIO' defined by the following equation is less than or equal to 0:

$$RATIO' = \frac{R_{INS}}{CEP} - X$$

wherein $$X = 0.5007 \times (R_{SHELL} - R_{INS}) + 0.5697$$

$R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

11. A method according to claim 10 including increasing X by 10% before calculating the RATIO'.

12. A method according to claim 10, wherein the insulator includes a core nose projection having a length extending from the shell firing surface to the insulator tip, and the step of reducing the insulator thickness includes tapering the insulator thickness between the shell firing surface and the insulator tip so that the taper in the insulator thickness extends along a percentage of the length of the core nose projection, and the percentage of the length is greater than or equal to a calculated percentage defined according to the following equation:

$$Y = -2.9\% \times \left(\frac{R_{CE}}{R_{INS} - R_{CE}}\right) + 59.56\%$$

wherein Y is the percentage of the length of the core nose projection of the insulator, $R_{CE}$ is a radius of the center electrode, the radius of the center electrode being a distance extending from the center axis to an electrode outer surface, and $R_{INS}$ is a radius of the insulator, the radius of the insulator is a distance extending from the center axis to the insulator outer surface, and the radius of the insulator is measured along a portion of the insulator wherein the insulator thickness is constant.

13. A method according to claim 10, wherein the insulator includes a core nose projection having a length extending from the shell firing surface to the insulator tip, the insulator thickness is constant along a first portion of the insulator, and the step of reducing the insulator thickness includes taping the insulator thickness along a second portion of the insulator extending from the first portion toward the insulator tip so that the insulator thickness at the insulator tip relative to the insulator thickness at the first portion is reduced by greater than or equal to a percentage of the insulator thickness at the first portion, the percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS-R_{CE}}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of the insulator thickness at the first portion, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, $R_{CE}$ is a radius of the center electrode, the radius of the center electrode being a distance extending from the center axis to an electrode outer surface, and $R_{SHELL}$ is a radius of the shell, the radius of the shell being a distance extending from the center axis to a shell inner surface at the shell firing surface.

14. A method according to claim 10 including increasing a length of the shell so that the shell firing surface is closer to the insulator tip if a RATIO' defined by the following equation is less than or equal to 0:

$$RATIO' = \frac{R_{INS}}{CEP} - X$$

wherein $$X = 0.5007 \times (R_{SHELL} - R_{INS}) + 0.5697$$

$R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

15. A method of manufacturing a corona igniter, comprising the steps of:

providing an insulator formed of an insulating material, the insulator extending longitudinally along a center axis from an insulator upper end to an insulator tip, the insulator having a thickness extending from an insulator outer surface to an insulator inner surface, the insulator inner surface presenting a slot extending longitudinally along the center axis from the insulator upper end toward the insulator tip, and the insulator outer surface being round at the insulator tip;

providing a central electrode disposed in the slot of the insulator and extending longitudinally from an electrode upper end to an electrode tip, the electrode tip being spaced from the insulator tip by the insulating material;

providing a shell formed of metal surrounding a portion of the insulator and extending longitudinally from a shell upper end to a shell firing surface;

increasing a length of the shell so that the shell firing surface is closer to the insulator tip if a RATIO' defined by the following equation is greater than or equal to 0:

$$RATIO' = \frac{R_{INS}}{CEP} - X$$

wherein $$X = 0.5007 \times (R_{SHELL} - R_{INS}) + 0.5697$$

$R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

16. A method according to claim 15 including increasing X by 10% before calculating the RATIO'.

17. A method according to claim 15, wherein the insulator includes a core nose projection having a length extending from the shell firing surface to the insulator tip, reducing the insulator thickness at the insulator tip relative to the insulator thickness at the shell firing surface if the RATIO' is less than or equal to 0, the step of reducing the insulator thickness includes tapering the insulator thickness between the shell firing surface and the insulator tip so that the taper in the insulator thickness extends along a percentage of the length of the core nose projection, and the percentage of the length is greater than or equal to a calculated percentage defined according to the following equation:

$$Y = -2.9\% \times \left(\frac{R_{CE}}{R_{INS} - R_{CE}}\right) + 59.56\%$$

wherein Y is the percentage of the length of the core nose projection of the insulator, $R_{CE}$ is a radius of the center electrode, the radius of the center electrode being a distance extending from the center axis to an electrode outer surface, and $R_{INS}$ is a radius of the insulator, the radius of the insulator being a distance extending from the center axis to the insulator outer surface along a portion of the core nose projection wherein the insulator thickness is constant.

18. A method according to claim 15, wherein the insulator includes a core nose projection having a length extending from the shell firing surface to the insulator tip, the insulator thickness is constant along a first portion of the insulator, and the step of reducing the insulator thickness includes taping the insulator thickness along a second portion of the insulator extending from the first portion toward the insulator tip so that the insulator thickness at the insulator tip relative to the insulator thickness at the first portion is reduced by greater than or equal to a percentage of the insulator thickness at the first portion, the percentage being defined by the following equation:

$$T\ \% = 30.3\% - (45.2\% * P1) - (0.8\% * P2) + (4.2\% * P3) + 2.5\%,$$

wherein $$P1 = \frac{R_{INS}}{CEP},$$

$$P2 = \left(\frac{R_{CE}}{R_{INS-R_{CE}}}\right),$$

$$P3 = \frac{\ln\left(\frac{R_{SHELL}}{R_{INS}}\right)}{\ln\left(\frac{R_{INS}}{R_{CE}}\right)},$$

T % is a percentage of the insulator thickness at the first portion, $R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, $R_{CE}$ is a radius of the center electrode, the radius of the center electrode being a distance extending from the center axis to an electrode outer surface, and $R_{SHELL}$ is a radius of the shell, the radius of the shell being a distance extending from the center axis to a shell inner surface at the shell firing surface.

19. A method of manufacturing an insulator for a corona igniter, the corona igniter including the insulator and a shell surrounding a portion of the insulator and extending longitudinally from a shell upper end to a shell firing surface, the insulator being formed of an insulating material and extending longitudinally along a center axis from an insulator upper end to an insulator tip, the insulator having a thickness extending from an insulator outer surface to an insulator inner surface, the insulator inner surface presenting a slot extending longitudinally along the center axis from the insulator upper end toward the insulator tip for containing a center electrode, and the insulator outer surface being round at the insulator tip; and the step of providing the insulator including providing the insulator so that the insulator thickness tapers between a location to be aligned with the shell firing surface and the insulator tip, and the insulator thickness does not increase between a start of the taper and the insulator tip; and reducing the insulator thickness at the insulator tip relative to the insulator thickness at the location to be aligned with the shell firing surface if a RATIO' defined by the following equation is less than or equal to 0:

$$RATIO' = \frac{R_{INS}}{CEP} - X$$

wherein $$X = 0.5007 \times (R_{SHELL} - R_{INS}) + 0.5697$$

$R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

20. A method of manufacturing an insulator for a corona igniter, the corona igniter including the insulator and a shell surrounding a portion of the insulator and extending longitudinally from a shell upper end to a shell firing surface, the insulator being formed of an insulating material and extending longitudinally along a center axis from an insulator upper end to an insulator tip, the insulator having a thickness extending from an insulator outer surface to an insulator inner surface, the insulator inner surface presenting a slot extending longitudinally along the center axis from the insulator upper end toward the insulator tip for containing a center electrode, and the insulator outer surface being round at the insulator tip; and increasing a length of the shell so that the shell firing surface is closer to the insulator tip if a RATIO' defined by the following equation is greater than or equal to 0:

$$RATIO' = \frac{R_{INS}}{CEP} - X$$

wherein $$X = 0.5007 \times (R_{SHELL} - R_{INS}) + 0.5697$$

$R_{INS}$ is a radius of the insulator, the radius of the insulator is a distance extending from the center axis to the insulator outer surface, and the radius of the insulator is measured along a portion of the insulator wherein the insulator thickness is constant, CEP is a distance between the shell firing surface and the electrode tip, and $R_{SHELL}$ is a radius of the shell, the radius of the shell being a distance extending from the center axis to a shell inner surface at the shell firing surface.

21. An internal combustion engine, comprising:

an engine block including a top wall with an opening, said engine block including side walls extending from said top wall and forming a combustion chamber;

a corona igniter disposed in said opening of said cylinder head and extending into said combustion chamber, said corona igniter including an insulator formed of an insulating material, said insulator extending longitudinally along a center axis from an insulator upper end to an insulator tip, said insulator having a thickness extending from an insulator outer surface to an insulator inner surface, said insulator inner surface presenting a slot extending longitudinally along said center axis from said insulator upper end toward said insulator tip, and said insulator outer surface being round at said insulator tip, said insulator including a core nose projection having a length extending from said shell firing surface to said insulator tip, said taper in said insulator thickness extending along a percentage of said length of said core nose projection, and said percentage of said length being greater than or equal to a calculated percentage defined according to the following equation:

$$Y = -2.9\% \times \left(\frac{R_{CE}}{R_{INS} - R_{CE}}\right) + 59.56\%$$

wherein Y is said percentage of said length of said core nose projection of said insulator, $R_{CE}$ is a radius of said center electrode, said radius of said center electrode is a distance extending from said center axis to an electrode outer surface, and $R_{INS}$ is a radius of said insulator, said radius of said insulator is a distance extending from said center axis to said insulator outer surface, and said radius of said insulator is measured along a portion of said insulator wherein said insulator thickness is constant, a central electrode disposed in said slot of said insulator and extending longitudinally from an electrode upper end to an electrode tip, said electrode tip being spaced from said insulator tip by said insulating material;

a shell formed of metal surrounding a portion of said insulator and extending longitudinally from a shell upper end to a shell firing surface; and said shell firing surface and a portion of said shell located above said shell firing surface being disposed in said combustion chamber.

22. An internal combustion engine, comprising:

an engine block including a top wall with an opening, said engine block including side walls extending from said top wall and forming a combustion chamber;

a corona igniter disposed in said opening of said cylinder head and extending into said combustion chamber, said corona igniter including an insulator formed of an insulating material, said insulator extending longitudinally along a center axis from an insulator upper end to an insulator tip, said insulator having a thickness extending from an insulator outer surface to an insulator inner surface, said insulator inner surface presenting a slot extending longitudinally along said center axis from said insulator upper end toward said insulator tip, and said insulator outer surface being round at said insulator tip, a central electrode disposed in said slot of said insulator and extending longitudinally from an electrode upper end to an electrode tip, said electrode tip being spaced from said insulator tip by said insulating material;

a shell formed of metal surrounding a portion of said insulator and extending longitudinally from a shell upper end to a shell firing surface; and said shell firing surface and a portion of said shell located above said shell firing surface being disposed in said combustion chamber.

* * * * *